US005808308A

United States Patent [19]

Holkeboer

[11] Patent Number: 5,808,308

[45] Date of Patent: Sep. 15, 1998

[54] DUAL ION SOURCE

[75] Inventor: David H. Holkeboer, Liverpool, N.Y.

[73] Assignee: Leybold Inficon Inc., East Syracuse, N.Y.

[21] Appl. No.: 863,818

[22] Filed: May 27, 1997

Related U.S. Application Data

[63] Continuation of Ser. No. 642,479, May 3, 1996, abandoned.

[51] Int. Cl.[6] ..... H01J 39/34

[52] U.S. Cl. ..... 250/423 R; 250/427; 250/283

[58] Field of Search ..... 250/423 R, 424, 250/427, 288, 288 A, 283, 285, 281, 282

[56] References Cited

U.S. PATENT DOCUMENTS

| | | | |
|---|---|---|---|
| 3,307,033 | 2/1967 | Vestal | 250/283 |
| 3,392,280 | 7/1968 | Friedman et al. | 250/123 R |
| 3,405,263 | 10/1968 | Wanless et al. | 250/285 |
| 3,602,709 | 8/1971 | Hull | 250/281 |
| 3,796,872 | 3/1974 | Merren | 250/283 |
| 3,831,026 | 8/1974 | Powers | 250/296 |
| 3,849,656 | 11/1974 | Wallington | 250/424 |
| 3,924,124 | 12/1975 | Favre et al. | 250/281 |
| 3,974,380 | 8/1976 | Rettinghaus et al. | 250/423 R |
| 3,984,692 | 10/1976 | Arsenault | 250/423 R |
| 4,068,122 | 1/1978 | Schmidt et al. | 250/281 |
| 4,507,555 | 3/1985 | Chang | 250/281 |
| 4,620,095 | 10/1986 | Miziolek | 250/281 |
| 5,153,432 | 10/1992 | Devant et al. | 250/292 |
| 5,412,207 | 5/1995 | Micco et al. | 250/288 |

FOREIGN PATENT DOCUMENTS

| | | | |
|---|---|---|---|
| 55-23405 | 2/1980 | Japan | 250/288 A |

*Primary Examiner*—Kiet T. Nguyen
*Attorney, Agent, or Firm*—Wall Marjama & Bilinski

[57] ABSTRACT

A dual beam ion source comprises an ion volume in an ion chamber, an ion collector, and two identical ion accelerators. One ion accelerator accelerates a first, "test" ion stream from the ion volume in a first direction and directs it to the ion collector where it can be directly measured. The second ion accelerator accelerates a second, "utilizable" ion stream from the ion volume in a second direction. By directly measuring the ion current (caused by the first, "test" ion stream) at the ion collector, either or both the total ion pressure of the gas within the ion volume, and the magnitude of the second, "utilizable" ion stream, can be calculated.

7 Claims, 3 Drawing Sheets

DUAL ION SOURCE

This application is a continuation of application Ser. No. 08/642,479 filed May 3, 1996, now abandoned.

FIELD OF THE INVENTION

This invention relates generally to ion generation, and more specifically to generating and measuring ion streams for se by mass spectrometers and other instruments.

BACKGROUND AND SUMMARY OF THE INVENTION

Many scientific instruments, such as mass spectrometers using quadrupole filters, require generation of an ion stream so that ions may be accelerated or otherwise input into the instrument for sample identification, measurement, and other purposes.

For a quadrupole residual gas analyzer, it is desirable to indicate the ionization current as a total pressure measurement, in addition to filtering the ion current to indicate specific ion species.

A conventional ion source comprises a filament acting as an electron emitter, with an ion volume containing rarified gas, and an ion accelerator. Electrons from the filament enter the ion volume through an opening in an ionization chamber surrounding the ion volume, and ionize gas molecules within the ion volume. The ion accelerator draws the resulting ions out of the ion volume and focuses them into a beam of ions suitable for injection into the quadrupole filter or other instrument.

When using such a device, it is usually desirable to have an accurate measurement of the ion stream or ion current being supplied to the quadrupole filter or other instrument. One conventional method for measuring ion current is typically to measure an ion current at the ion accelerator, since a portion of the ion stream impacts on the ion accelerator. However, this method has several drawbacks. For example, the ion accelerator will often have electrical leakage. The measurement may also be affected by stray currents from the ionization process.

Another conventional method is to place an ion collector in the path of the ion stream. However, this method the drawback of interfering with the ion stream.

Also, in both of the above methods, and in others where, similarly, only a fraction of the ion stream is measured, it is difficult to judge the exact useable ion current by measuring the "test" fraction, because as the intensity of the total ion stream varies, the ratio between the "utilizable" portion of the ion stream and the "test" portion striking the measurement collector may vary in unknown ways.

Accordingly, it is an object of this invention to provide a method of measuring the ion current of an ion stream wherein the "test" ion stream being directly measured varies proportionally in the same way that the "utilizable" ion stream varies.

It is also an object of this invention to provide a method of measuring the ion current of an ion stream without affecting the ion stream.

It is another object of the invention to measure ionization current while diminishing errors due to electron leakage or stray currents from the ionization process.

It is a further object of the invention to be able to indicate the ion current as a total pressure measurement.

These objects of the present invention are accomplished by providing a dual beam ion source comprising an ion volume in an ion chamber, an ion collector, a first ion accelerator for accelerating a first, "test" ion stream from the ion volume in a first direction and directing it to the ion collector where it can be directly measured, and a second ion accelerator for accelerating a second, "utilizable" ion stream from the ion volume in a second direction.

An additional advantage of the invention is that the total current collector can be isolated from leakages and from stray radiation which limit the detection of small currents. Additionally, the total current is available at all times for emergency shutdown if required.

BRIEF DESCRIPTION OF THE DRAWING

For a fuller understanding of the nature and objects of the invention, reference should be made to the following detailed description of two possible architectures for practicing the invention, read in connection with the accompanying drawing, in which.

DETAILED DESCRIPTION

Figure 1:
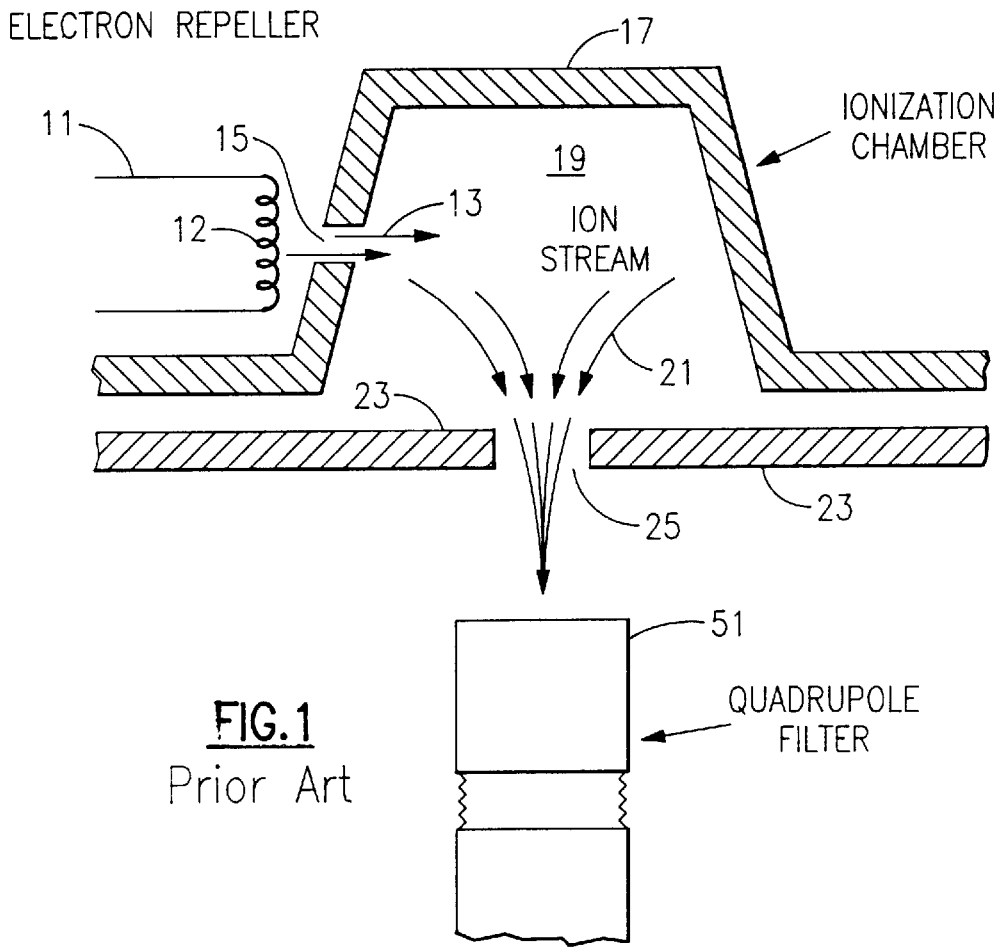
FIG.1 Prior Art
FIG. 1 is a cross-section of an ion source according to the prior art.

A conventional ion source is shown in FIG. 1. An electron emitter 11 including a filament 12 emits electrons 13 that pass through an opening 15 in an ionization chamber 17 into an ionization volume 19 containing rarified gas. The electrons interact with the gas molecules, ionizing some of them. The ions 21 so produced are accelerated by an ion accelerator or focus plate 23 through an opening 25 in the ion accelerator 23, and are focussed into an ion beam for use by a quadrupole filter 51 or other instrument.

In one embodiment of a dual ion source according to the invention, the dual ion source comprises a symmetrical combination of two conventional ion sources sharing a common ion volume. Electrons from a common emitter (or separate emitters) enter the ion volume preferably through two openings, forming ions in two locations. Two identical accelerator plates, electrically connected if desired, draw ion beams out of the ion volume in respectively different directions. The first ion beam is directed to a total current collector for measuring total ion pressure of the gas in the ion volume, and a second ion beam is directed to an analyzer, "analyzer" being defined as a mass spectrometer, quadrupole filter, or any other instrument that uses or analyzes an ion stream.

Figure 4:
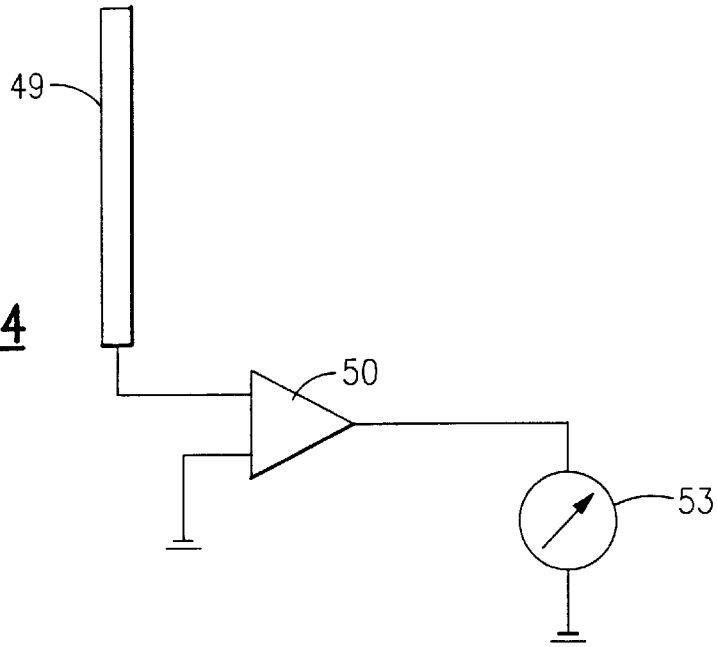
FIG. 4 is a simple functional diagram illustrating a current measuring means for calculating total ion pressure of gas within the ion volume from current measured at the ion collector.
Figure 2:
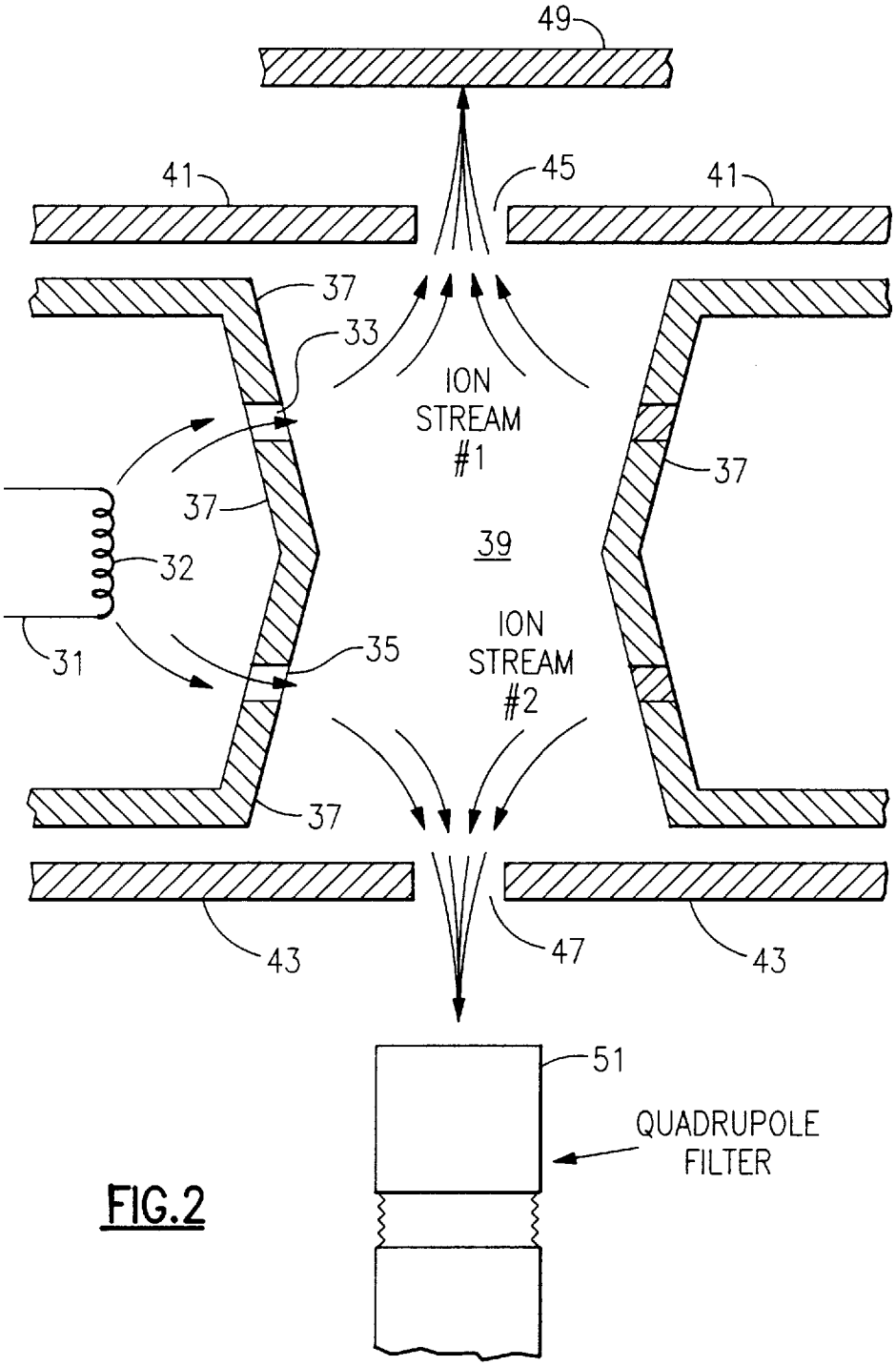
FIG. 2 is a cross-section of a dual ion source according to the present invention.

One embodiment of a dual ion source according to the invention is illustrated in FIG. 2. Electrons from electron emitter 31 including one or more filaments 32 pass through openings 33, 35 in ionization chamber 37 surrounding an ionization volume 39. The electrons interact with gas within the ionization volume 39, forming ions. Two separate, preferably identical ion accelerators or focus plates 41, 43 draw and focus the ions into first and second ion streams, respectively, which pass through respective openings 45, 47 in the ion accelerators or focus plates 41, 43. The first, or "test" ion stream, ion stream #1, is directed toward a total current collector 49. As illustrated in FIG. 4, current from the collector plate 49 can easily be measured and an indicator 53 can be calibrated to read the total ion pressure of the gas in the ionization volume 39. The indicator 53 can be anything from a simple gauge hard-calibrated to read in atmospheres, to a computer utilizing a-priori data to calculate total ion pressure based on the ion current measured at the collector plate 49.

Returning to FIG. 2, the second, or "utilizable" ion stream, ion stream #2, is directed by ion accelerator 43 toward quadrupole filter 51 or any other device utilizing ion streams. Once the total ionization pressure is measured as explained above, the magnitude of ion stream #2 can be readily calculated, since the same volume of gas in ionization volume 39 is responsible for producing both ion streams.

Alternatively, calibration data can be obtained by placing a second current collector or other instrument (not shown) in place of the quadrupole filter 51, to calibrate the reading from ion stream #1 with the actual ion stream #2. These data may be obtained at the factory during construction of the dual ion source, or before integration of the dual ion source with the mass spectrometer or other instrument utilizing it. It will be understood that thereafter, by referencing the data obtained during the calibration, the ion current or magnitude of the second ion stream will be readily obtainable from the current reading received at the total current collector 49 from the first ion stream. FIG. 4 can also illustrate the current from the collector plate 49 being measured and (in this case) the indicator 53 can be calibrated (using the data obtained during the calibration), to read the ion current or magnitude of the second ion stream based on the current from the collector plate 49. An amplifier 50 between collector plate 49 and indicator 53 amplifies, as necessary, the current collected at collector plate 49. Again, in this case the indicator 53 can be anything from a simple hard-calibrated gauge to a computer utilizing the data obtained during the calibration as a-priori data to calculate ion current or magnitude of the second ion stream based on the ion current of the first ion stream measured at the collector plate 49.

Figure 3:
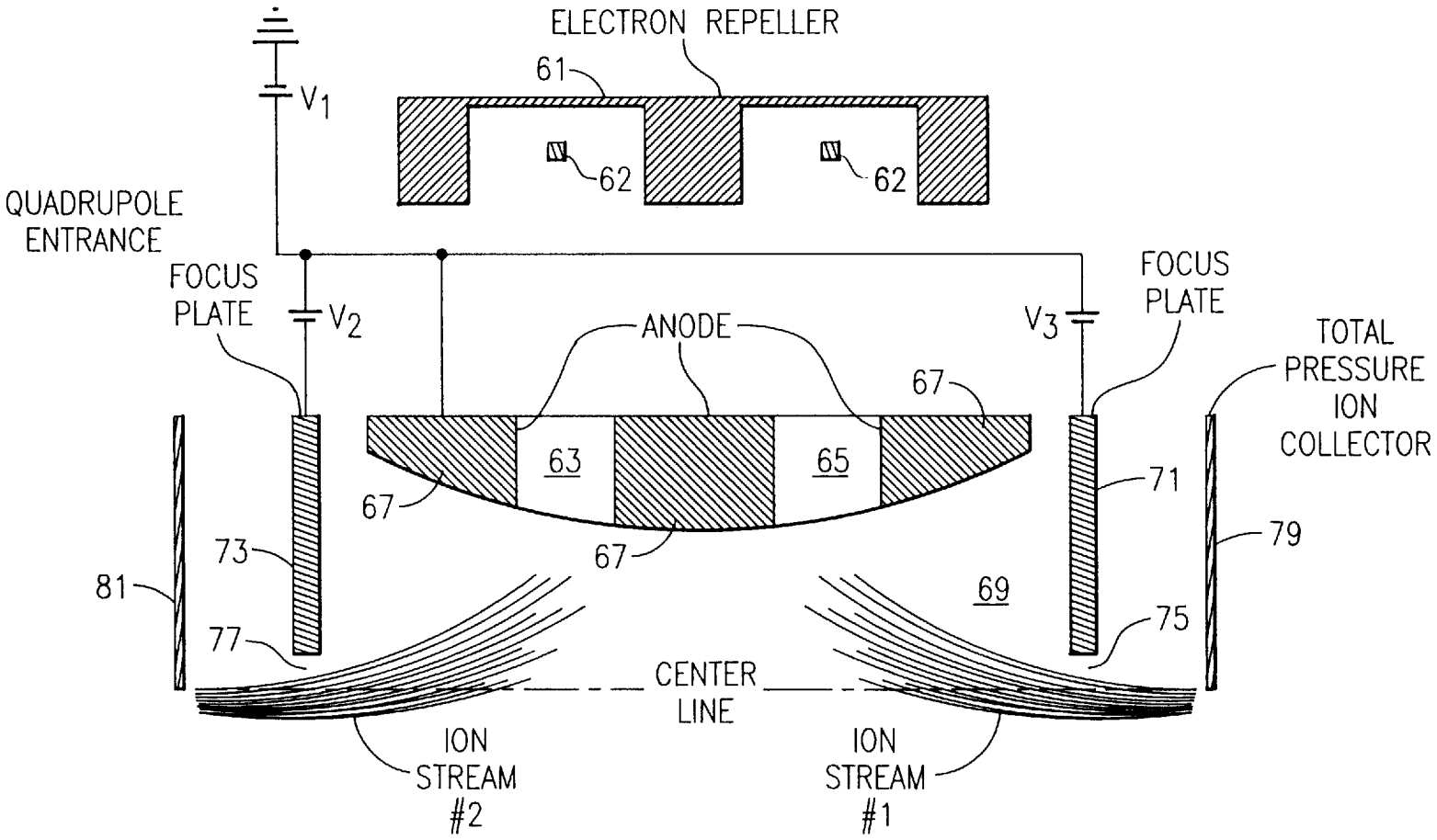
FIG. 3 is a partial cross-sectional diagram showing a particular configuration of the invention, and showing ion trajectories resulting therefrom.

FIG. 3 illustrates part of one particular configuration of an embodiment according to the present invention. An electron emitter 61 with two separate electron ejecting filaments 62, 62 propels electrons through openings 63, 65 in ion chamber plate 67, into an ion volume 69 containing a rarified gas, where ions are formed as the electrons interact with the gas. A potential difference is formed between ion chamber plate 67 and focus plates 71, 73 so that ion chamber plate 67 acts as an anode and focus plates 71, 73 act as cathodes, in order that ion streams #1 and #2 are propelled through respective openings 75 and 77. For example, a voltage source V1 places a positive bias on ion chamber plate 67. Voltage sources V2 and V3 place positive biases on focus plate 73 and focus plate 71, which are less positive than voltage source V1. Ion stream #1 arrives and is measured at total pressure ion collector 79. Ion stream #2 arrives at a structure 81 which can represent either the entrance to a quadrupole mass filter or other analyzer, or a second current collector or other instrument for initial calibration as described above with reference to FIG. 2.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. An apparatus for determining a total ion pressure of a gas, comprising:

an ion chamber plate defining an ionization chamber and a single ion volume therein;

ionization means for ionizing molecules of said gas within said ionization chamber to produce first and second ion streams within said single ion volume;

first and second ion accelerators;

an ion collector;

an analyzer;

means for establishing a first voltage difference between said ion chamber plate and said first ion accelerator, such that said first ion stream is directed toward said ion collector;

means for establishing a second voltage difference between said ion chamber plate and said second ion accelerator, such that said second ion stream is directed toward said analyzer;

means for collecting said first ion stream at said ion collector;

means for measuring a reference current produced by said first ion stream at said ion collector; and means, using said reference current, for calculating said total ion pressure of said gas within said single ion volume.

2. An apparatus according to claim 1, wherein said analyzer includes means for calculating at least one partial pressure of said gas within said single ion volume.

3. An apparatus according to claim 1, wherein said ionization means comprises:

emission means for emitting a plurality of electrons; and first and second openings in said ion chamber plate, whereby a first portion of said plurality of electrons passes through said first opening to produce said first ion stream in said single ion volume, and whereby a second portion of said plurality of electrons passes through said second opening to produce said second ion stream in said single ion volume.

4. An apparatus according to claim 3, wherein said emission means comprises first and second filaments wherein said first filament produces said first portion of said plurality of electrons and said second filament produces said second portion of said plurality of electrons.

5. An apparatus according to claim 3, wherein:

said ion chamber plate includes first and second regions;

said first opening being in said first region;

said second opening being in said second region; and said first and second regions being at an angle to each other such that said first and second portions of said plurality of electrons are focused to separate locations within said single ion volume.

6. An apparatus for determining a total ion pressure of a gas sample, comprising:

emission means for emitting a plurality of electrons;

an anode having first and second openings therein defining first and second ionization regions;

a first portion of said plurality of electrons passing through said first opening to produce a first ion stream in said first ionization region;

a second portion of said plurality of electrons passing through said second opening to produce a second ion stream in said second ionization region;

first and second ion focus plates;

a total pressure ion collector;

a gas analyzer;

means for establishing a first voltage difference between said anode and said first ion focus plate such that said first ion stream is directed to said total pressure ion collector;

means for establishing a second voltage difference between said anode and said second focus plate such that said second ion stream is directed to said gas analyzer;

means, responsive to said first ion stream impinging on said total pressure ion collector, for determining said total ion pressure of said gas sample;

means, responsive to said second ion stream received in said gas analyzer, for determining at least one partial pressure of said gas sample; and said first and second ionization regions being in close proximity such that said total partial pressure and said at least one partial pressure are determined from said same gas sample.

7. An apparatus according to claim 6, wherein said emission means comprises first and second filaments wherein said first filament produces said first portion of said plurality of electrons and said second filament produces said second portion of said plurality of electrons.

* * * * *